US008616663B2

(12) United States Patent
Ton

(10) Patent No.: US 8,616,663 B2
(45) Date of Patent: Dec. 31, 2013

(54) ADJUSTABLE CABINET

(76) Inventor: Quy That Ton, Baton Rouge, LA (US)

( * ) Notice: Subject to any disclaimer, the term of this patent is extended or adjusted under 35 U.S.C. 154(b) by 488 days.

(21) Appl. No.: 12/847,377

(22) Filed: Jul. 30, 2010

(65) Prior Publication Data

US 2012/0025681 A1 Feb. 2, 2012

(51) Int. Cl.
*A47B 51/00* (2006.01)

(52) U.S. Cl.
USPC ..... 312/312; 312/196

(58) Field of Classification Search
USPC ..... 312/205, 294, 306, 308, 312, 283, 312/249.8, 249.11, 249.12, 249.13, 194, 312/195, 196, 257.1
See application file for complete search history.

(56) References Cited

U.S. PATENT DOCUMENTS 294,388 A * 3/1884 Hull ..... 312/196
498,175 A * 5/1893 Lawson ..... 312/220
654,922 A * 7/1900 Schipkowsky ..... 312/196
1,556,711 A * 10/1925 Pietrzycki ..... 312/107
2,677,587 A * 5/1954 Waldo, Sr. ..... 312/249.8
2,931,685 A * 4/1960 Myra ..... 312/196
2,944,861 A * 7/1960 Lessin ..... 312/196
3,211,506 A * 10/1965 Levy et al. ..... 312/239
4,088,380 A * 5/1978 Watts ..... 312/237
4,735,471 A * 4/1988 Riggsby ..... 312/312
2010/0231104 A1* 9/2010 Hernandez ..... 312/249.12

* cited by examiner

*Primary Examiner* — James O Hansen
(74) *Attorney, Agent, or Firm* — Minh N. Nguyen, Esq.; Next IP Law Group LLP

(57) ABSTRACT

A representative adjustable cabinet includes a bottom section, a top section, a release mechanism, and a ladder component. The bottom section includes a top wall. The top section is positioned above the bottom section and includes at least one side wall. The release mechanism is placed at the top wall and includes at least one bar that extends horizontally along a plane of the top wall. The ladder component is placed at the at least one side wall of the top section and engages the at least one bar of the release mechanism to facilitate adjusting the top section downward and upward in relation to the bottom section.

14 Claims, 6 Drawing Sheets

ADJUSTABLE CABINET

TECHNICAL FIELD

The present disclosure is generally related to cabinets and, more particularly, is related to adjustable cabinets that are used in manicure and pedicure salons and spas.

BACKGROUND

In the cosmetic and beautician industry, a nail technician keeps multiple nail products and grooming supplies in portable cabinets. However, the portable cabinets are only used for storing and not for servicing customers to receive a manicure.

SUMMARY

A representative adjustable cabinet includes a bottom section, a top section, a release mechanism, and a ladder component. The bottom section includes a top wall. The top section is positioned above the bottom section and includes at least one side wall. The release mechanism is placed at the top wall of the bottom section and includes at least one bar that extends horizontally along a plane of the top wall. The ladder component is placed at the at least one side wall of the top section and engages the at least one bar of the release mechanism to facilitate adjusting the top section in a downward and upward direction in relation to the bottom section.

Other systems, devices, methods, features of the invention will be or will become apparent to one skilled in the art upon examination of the following figures and detailed description. It is intended that all such systems, devices, methods, features be included within the scope of the invention, and be protected by the accompanying claims.

BRIEF DESCRIPTION OF DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, the reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Exemplary systems are discussed with reference to the figures. Although these systems are described in detail, they are provided for purposes of illustration only and various modifications are feasible.

Figure 1:
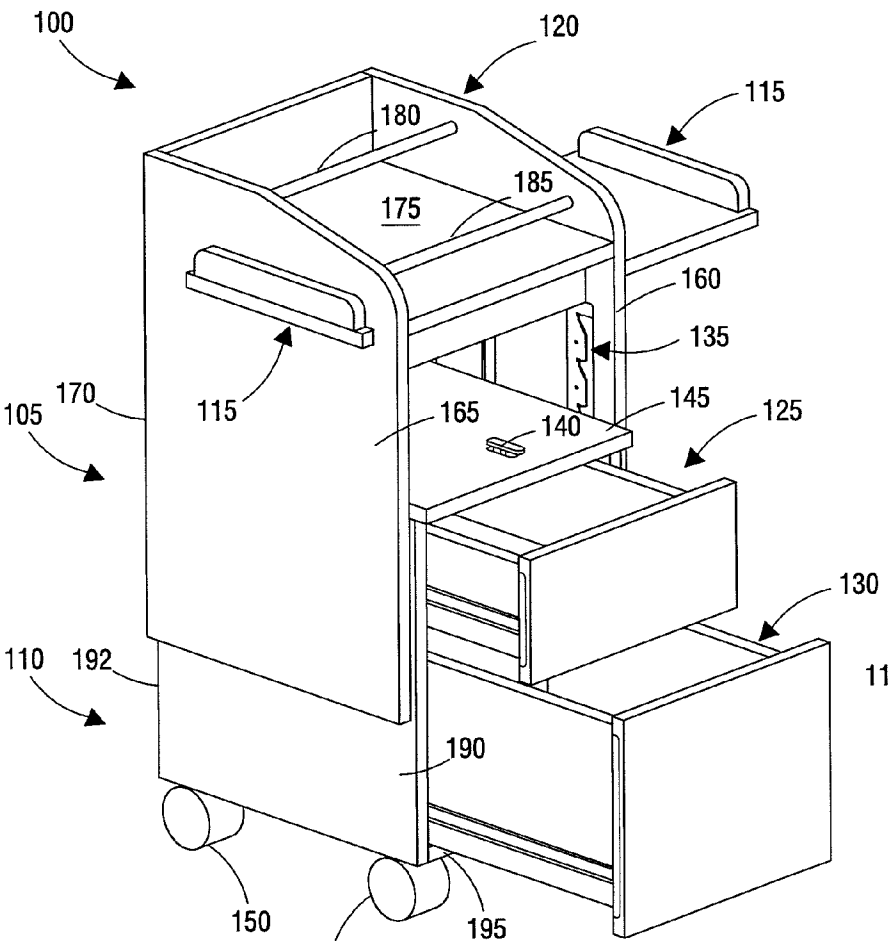
FIG. 1 is a perspective view of an adjustable cabinet in accordance with an embodiment of the present disclosure.

FIG. 1 is a perspective view of an adjustable cabinet 100 in accordance with an embodiment of the present disclosure. The adjustable cabinet 100 includes a top section 105 that is positioned above a bottom section 110. The top section 105 can be adjusted to move vertically in relation to the bottom section 110 by utilizing a release mechanism 605 (FIG. 6) and a ladder component 135, which are further described in connection with FIGS. 3 and 6-9.

The top section 105 includes side walls 160, 165, 170 and a top wall 175. The side walls 160, 165, 170 extend beyond the top wall 175. Dowels 180, 185 are attached to the side walls 160, 165 to create multiple storing compartments 120 for nail products and grooming supplies. The top section 105 includes extendable surfaces 115 that extend horizontally in and out of the side walls 160, 165 along the plane of the top wall 175 of the top section 105. The extendable surfaces 115 provides a nail technician a surface area to perform, for example, manicure services on a customer.

The bottom section 110 includes side walls 190, 192, 197, a top wall 145, and a bottom wall 195. Wheels 150 are attached to the side walls 190, 197, enabling the cabinet 100 to be transportable. The bottom section 110 houses two drawers 125, 130 in this example. The perimeter of the top section 105 is slightly larger than the perimeter of the bottom section 110 such that the top section 105 can house the bottom section 110. As the top section 105 is adjusted upward, a storing compartment is created between the top wall 175 of the top section 105 and the top wall 145 of the bottom section 110.

Figure 2:
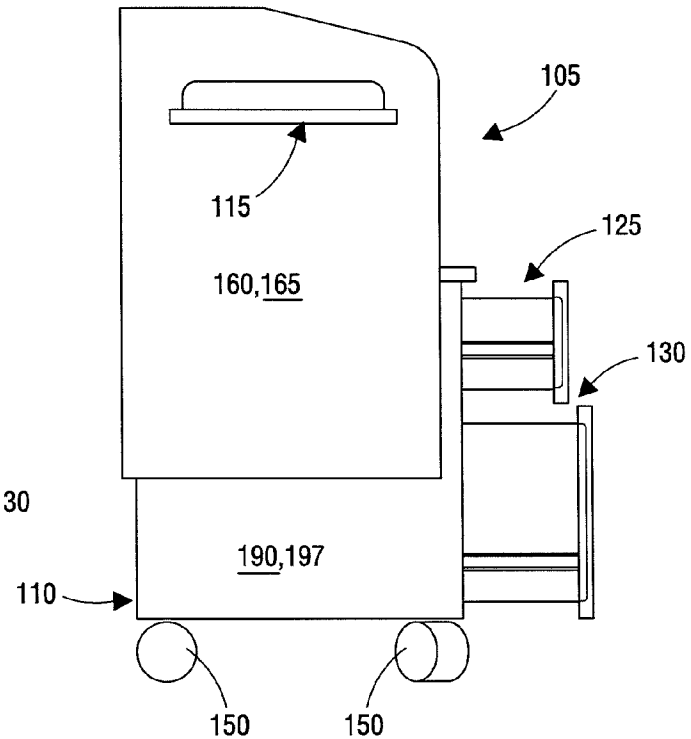
FIG. 2 is a side view of an adjustable cabinet in accordance with an embodiment of the present disclosure.

FIG. 2 is a side view of an adjustable cabinet 100 in accordance with an embodiment of the present disclosure. In this example, the side walls 160, 165 of the top section 105 do not completely cover the side walls 190, 197 of the bottom section 110. A portion of the side walls 190, 197 of the bottom section 110 extends slightly beyond the side walls 160, 165 of the top section 105 in the horizontal direction. The height of the side walls 160, 165 can be high enough that they cover the height of the side walls 190, 197.

Figure 3:
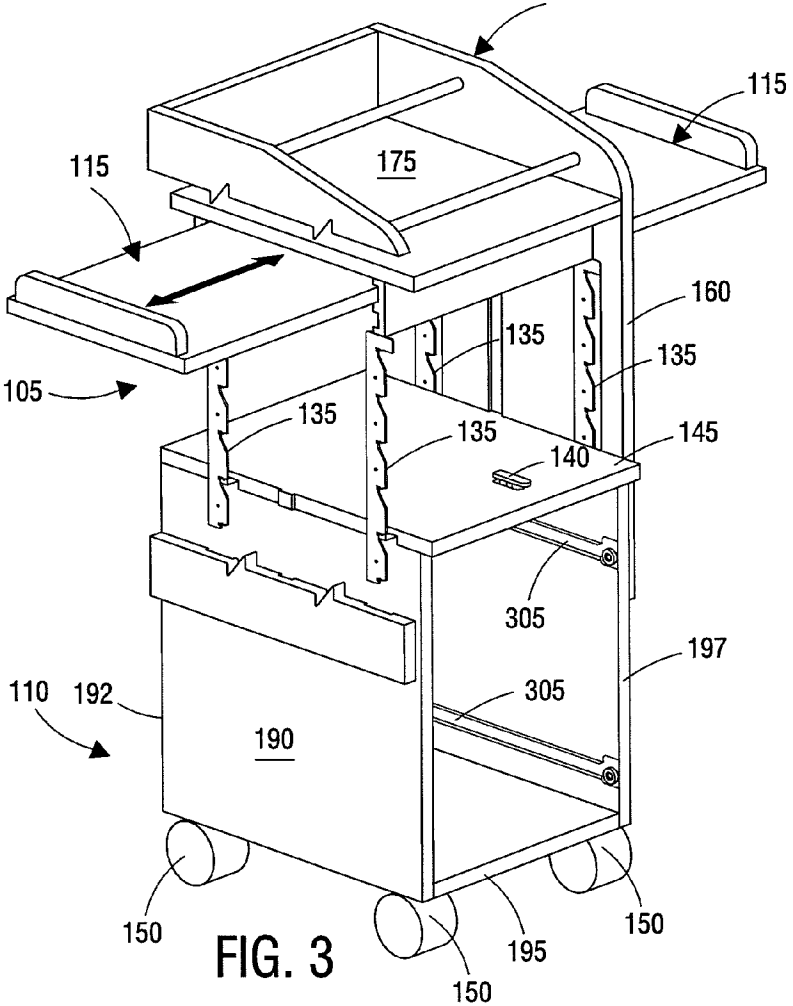
FIG. 3 is a perspective view of an adjustable cabinet, such as that shown in FIG. 1, having ladder components.

FIG. 3 is a perspective view of an adjustable cabinet 100, such as that shown in FIG. 1, having ladder components 135. Such ladder components 135 are placed at the side walls 160, 165 of the top section 105, and more specifically, on the inner surface of the side walls 160, 165. The ladder components 135 engage bars 510 (FIG. 5) of a release mechanism 605 (FIG. 6) to facilitate adjusting the top section 105 in a downward and upward direction in relation to the bottom section 110. The ladder components 135 are further described in connection with FIGS. 8 and 9. Rails 305 can be attached to the inner surface of the side walls 190, 197 of the bottom section 110, facilitating the drawers 125, 130 to slide in and out of the bottom section 110.

Figure 4:
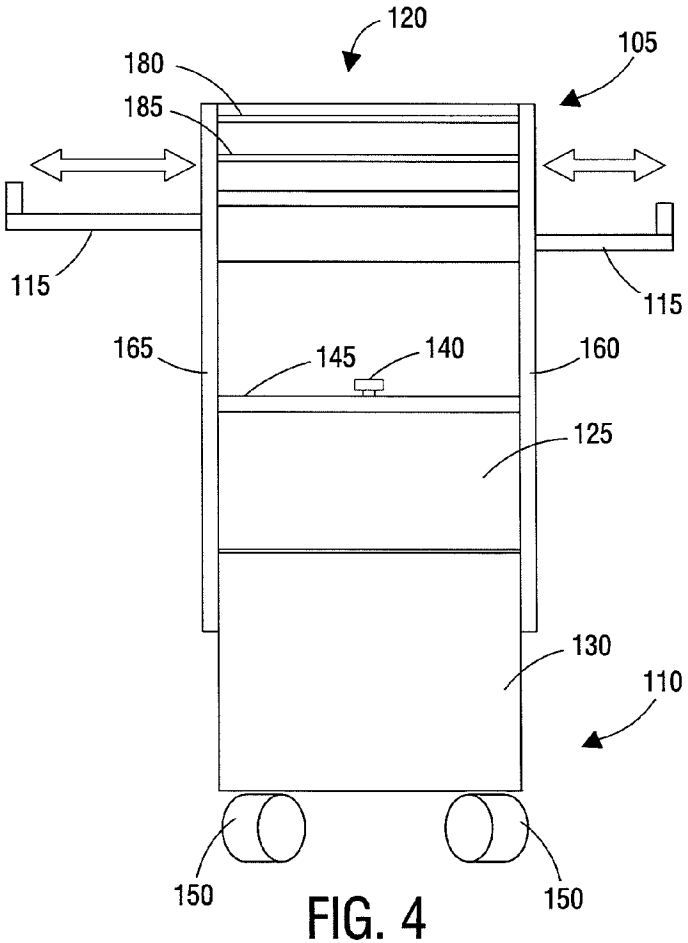
FIG. 4 is a front view of an adjustable cabinet in accordance with an embodiment of the present disclosure.

FIG. 4 is a front view of an adjustable cabinet 100 in accordance with an embodiment of the present disclosure. In this example, the dowel 180 is positioned slightly higher in height than the dowel 185 such that various sizes of nail products and grooming supplies can be stored accordingly. The left extendable surface 115 can be positioned below the top wall 175 of the top section 105 and the right extendable surface 115 can be positioned below the left extendable surface 115.

Figure 5:
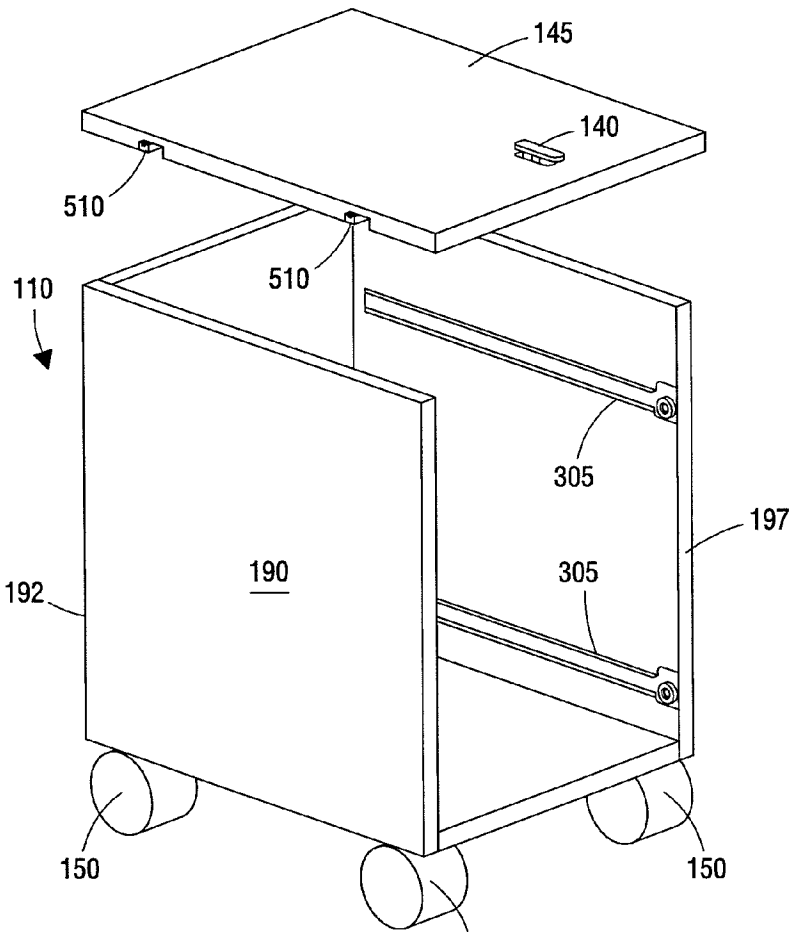
FIG. 5 is a partially preassembled view of a bottom section of an adjustable cabinet in accordance with an embodiment of the present disclosure.

FIG. 5 is a partially preassembled view of a bottom section 110 of an adjustable cabinet 100 in accordance with an embodiment of the present disclosure. The top wall 145 can be assembled to the side walls 190, 192, 197 and includes bars 510 that protrude away from the top wall 145 and extend beyond the side walls 190, 197 to engage the ladder component 135.

Figure 6:
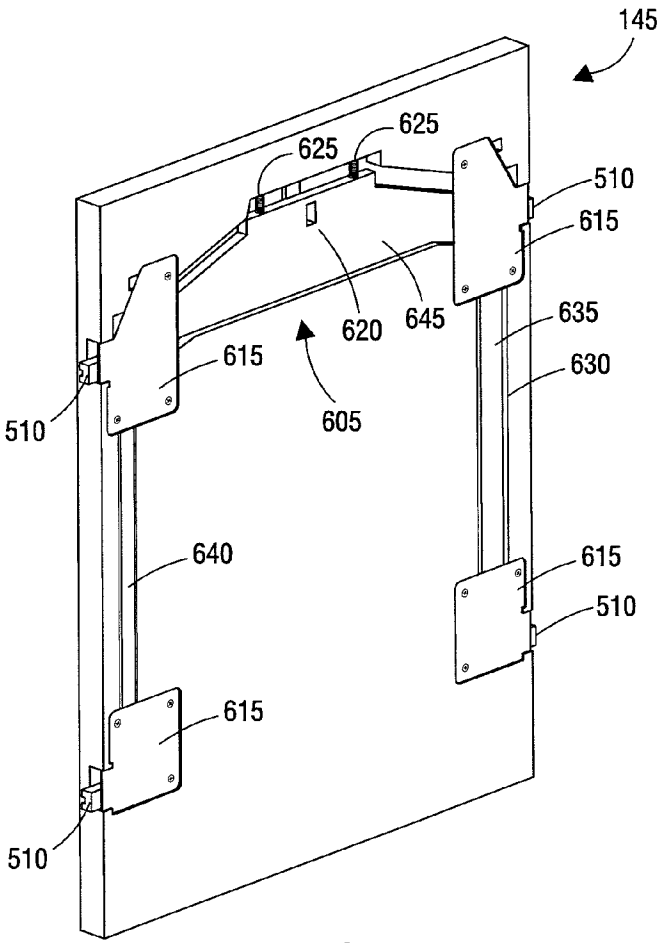
FIG. 6 is a bottom view of a top wall of a bottom section of an adjustable cabinet having a release mechanism in accordance with an embodiment of the present disclosure.

FIG. 6 is a bottom view of the top wall 145 of the bottom section 110 of the adjustable cabinet 100 having a release mechanism 605 in accordance with an embodiment of the present disclosure. The release mechanism 605 is placed at the bottom surface of the top wall 145 and includes, for example, four bars that extend horizontally along a plane of the top wall 145 and away from the top wall 145.

The release mechanism 605 includes a body 620 that has a shape of a letter "U" having a base portion 645 and two arm portions 635, 640. The four bars 510 are attached at corners and ends of the U-shaped body 620. The top wall 145 includes a cut-out portion 630 at the bottom surface of the top wall 145 that has a general shape of the body 620 of the release mechanism 605. The cut-out portion 630 houses the body 620 of the release mechanism 605, which is held in the cut-out portion 630 by plates 615.

Figure 7:
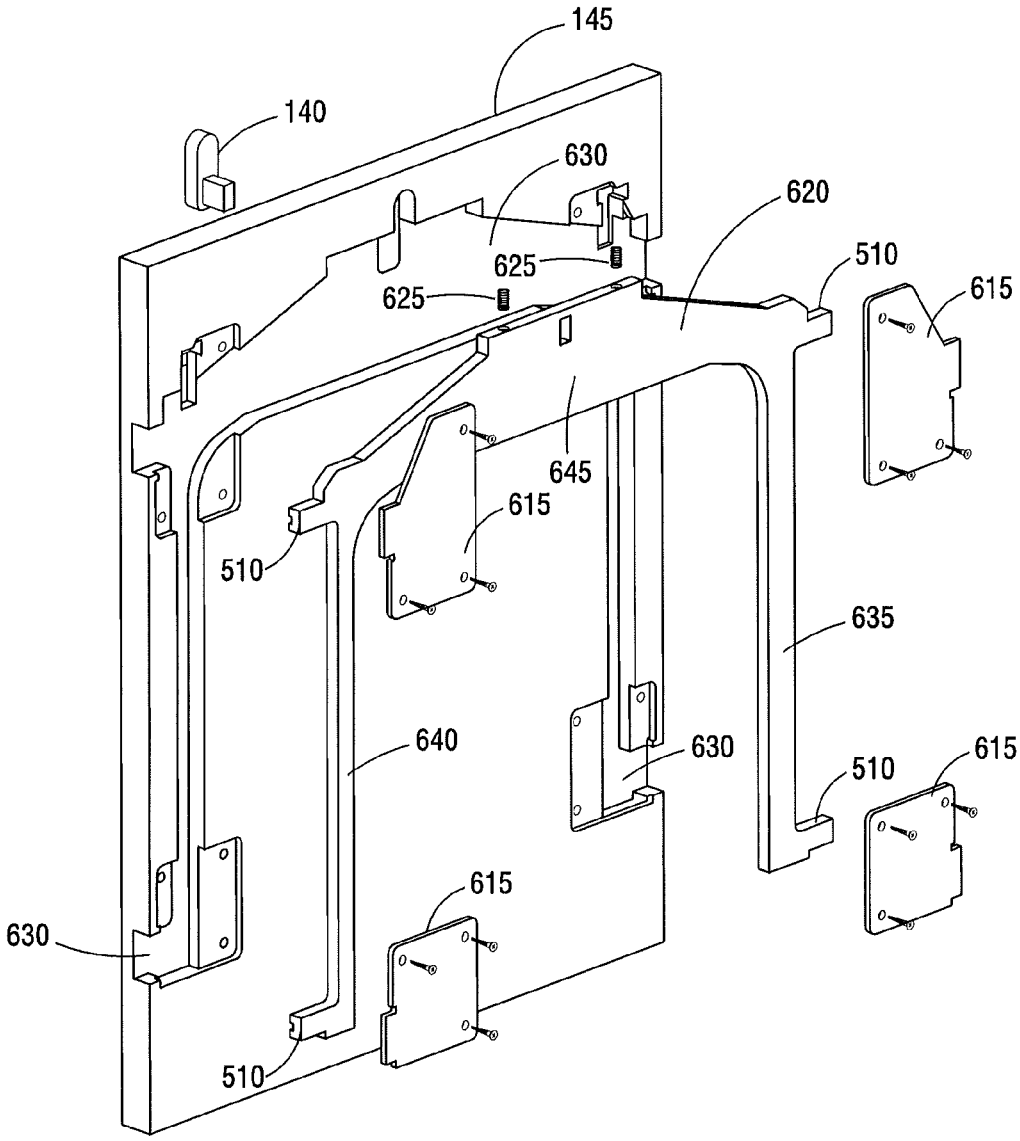
FIG. 7 is a preassembled view of a release mechanism in accordance with an embodiment of the present disclosure.

The handle 140 is attached to the base portion 645 of the U-shape body 620. The handle 140 is placed through a hole in the top wall 145 of the bottom section 110 such that the handle 140 is positioned at a top surface of the top wall 145 of the bottom section 110. The base portion 645 is mechanically coupled with springs 625, enabling a user to pull on the handle 140 to facilitate releasing the release mechanism 605 from the ladder component 135. The sequence of releasing the release mechanism 605 and adjusting the top section 105 is further described in connection to FIG. 9. FIG. 7 is a preassembled view of the release mechanism 605 such as that shown in FIG. 6.

Figure 8:
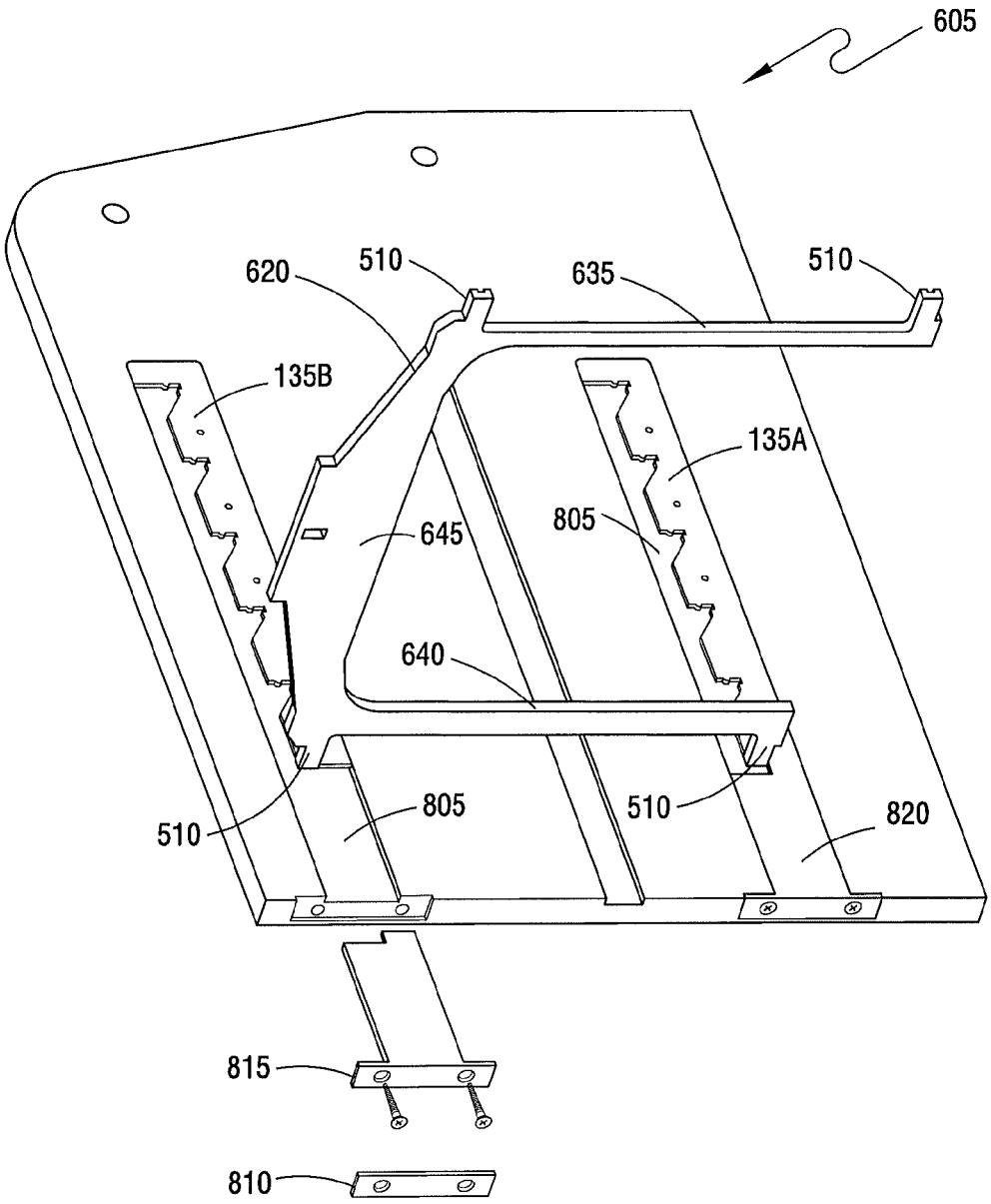
FIG. 8 is a partially preassembled view of a release mechanism and a ladder component that facilitate adjusting the height of a cabinet in accordance with an embodiment of the present disclosure.

FIG. 8 is a view of a release mechanism 605 and a ladder component 135 that facilitate adjusting a height of a cabinet 100 in accordance with an embodiment of the present disclosure. In this example, the side walls 190, 197 of the bottom section 110 each includes a cut-out portion 805 that has a general shape of the ladder component 135 and houses the ladder component 135. The bars 510 of the release mechanism 605 engage the ladder component 135 to facilitate adjusting the top section 105 in a downward and upward direction in relation to the bottom section 110.

The release mechanism 605 is positioned at the lowest step of the ladder component, which puts the cabinet at the maximum height. The lowest step of the ladder component 135 rests on the bar 510 of the release mechanism. To prevent the top section 105 from being lifted out of the bottom section 110, the ladder component 135 can include a stopper 810, 815, 820. In one embodiment, the stoppers 810, 815 can be a separate piece from the ladder component 135B. Alternatively, the stopper 820 can be integrally attached to the ladder component 135A forming a single piece.

FIGS. 9A-D illustrate a sequence of adjusting the height of a cabinet 100 from a step 915 to a succeeding step 950 of a ladder component 135 in accordance with an embodiment of the present disclosure. The bar 510 includes a groove 910 and the ladder component 135 includes a protrusion 905 located on each step 915 of the ladder component 135. The protrusion 905 engages the groove 910 on the bar 510 to lock the top section 105 at a height relative to the step 915 of the ladder component 135.

Figure 9A:
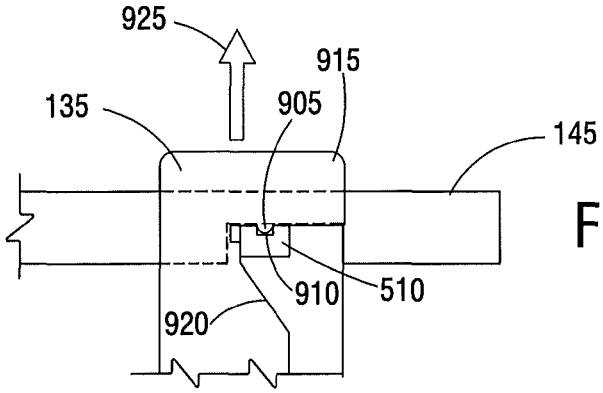
FIGS. 9A-D illustrate a sequence of adjusting the height of a cabinet from one step to a succeeding step of a ladder component in accordance with an embodiment of the present disclosure.
Figure 9B:
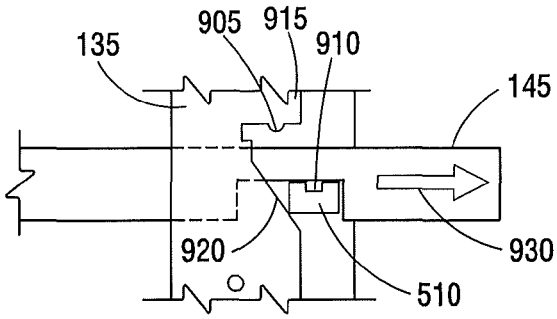

In this example, the bar 510 is engaged with the step 915 of the ladder component 135 at the lowest position of the cabinet 100. Beginning with FIG. 9A, to adjust the height of the cabinet 100 upward, the top section 105 is pulled in the upward direction 925 to facilitate releasing the bar 510 from the ladder component 135. In FIG. 9B, as the top section 105 is continually being pulled in upward direction 925, the bar 510 of the release mechanism 605 shifts to the right 930 via the springs 625 (FIG. 6) enabling the bar 510 to slide along a ledge 920 of the ladder component 135. The handle 140 can also be pulled toward the front of the cabinet 100 to facilitate shifting the bar 510 in the right direction 930.

Figure 9C:
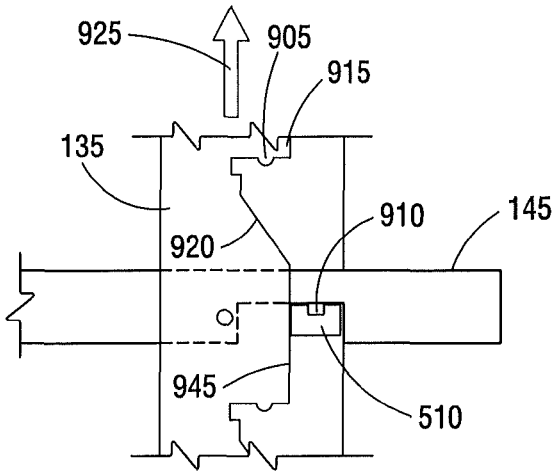
Figure 9D:
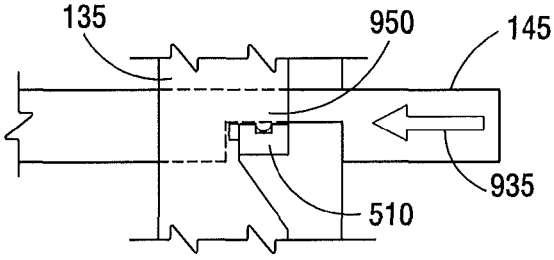

In FIG. 9C, as the top section 105 is continually being pulled in the upward direction 925, the bar 510 slides along a vertical edge 945 of the ladder component 135 that is located between the ledge 920 of the ladder component 135 and the succeeding step 950. Once the top section 105 is pulled to a height relative to the succeeding step 950 of the ladder component, the bar 510 slides in the left direction 935 via the springs 625 enabling the bar 510 to shift underneath the step 950. Once a user stops pulling the top section 105 upward and lets the top section 105 go, the step 950 rests on the bar 510 by gravitational force. The bar 510 locks to the step 950 via the protrusion 905 of the ladder component 135 and the groove 910 of the bar 510. To further increase the height of the cabinet in the upward direction, FIGS. 9A-D can be repeated.

This description has been presented for purposes of illustration and description. It is not intended to be exhaustive or to limit the disclosure to the precise forms disclosed. Obvious modifications or variations are possible in light of the above teachings. The embodiments discussed, however, were chosen to illustrate the principles of the disclosure, and its practical application. The disclosure is thus intended to enable one of ordinary skill in the art to use the disclosure, in various embodiments and with various modifications, as are suited to the particular use contemplated. All such modifications and variation are within the scope of this disclosure, as determined by the appended claims when interpreted in accordance with the breadth to which they are fairly and legally entitled.

Therefore, having thus described the disclosure, at least the following is claimed:

1. An adjustable cabinet comprising:

a bottom section that includes a top wall;

a top section that is positioned above the bottom section and includes at least one side wall;

a release mechanism that is placed at the top wall and includes at least one bar that extends horizontally along a plane of the top wall; and a ladder component that is placed at the at least one side wall of the top section and engages the at least one bar of the release mechanism to facilitate adjusting the top section downward and upward in relation to the bottom section;

wherein the release mechanism includes a body that has a shape of a letter "U" having the at least one bar at one or more corners and one or more ends of the U-shaped body, wherein the top wall of the bottom section includes a cut-out portion that has a general shape of the body of the release mechanism, wherein the cut-out portion houses the release mechanism.

2. The adjustable cabinet as defined in claim 1, wherein the at least one bar includes four bars extending horizontally at corners of the U-shaped body of the release mechanism, wherein the four bars extends along the plane of the top wall of the bottom section, wherein the bottom section includes four ladder components that engages the four bars to facilitate adjusting the top section in a downward and upward direction in relation to the bottom section.

3. The adjustable cabinet as defined in claim 1, wherein the release mechanism includes a handle that is attached to a base portion of the U-shaped body, wherein the handle is placed through a hole in the top wall of the bottom section such that the handle is positioned at a top surface of the top wall of the bottom section.

4. The adjustable cabinet as defined in claim 1, wherein the at least one side wall of the top section includes at least one cut-out portion on an inner surface of the at least one side wall of the top section, wherein the at least one cut-out portion houses the ladder component.

5. The adjustable cabinet as defined in claim 1, wherein the top section includes at least one extendable surface that extends horizontally in and out of the top section along the plane of the top wall of the top section.

6. The adjustable cabinet as defined in claim 1, wherein the top section includes at least one drawer.

7. An adjustable cabinet comprising:

a bottom section that includes a top wall;

a top section that is positioned above the bottom section and includes at least one side wall;

a release mechanism that is placed at the top wall and includes at least one bar that extends horizontally along a plane of the top wall; and a ladder component that is placed at the at least one side wall of the top section and engages the at least one bar of the release mechanism to facilitate adjusting the top section downward and upward in relation to the bottom section;

wherein the at least one bar includes a groove and the ladder component includes a protrusion located on each step of the ladder component, the protrusion engages the groove on the at least one bar to lock the top section at a height relative to a step of the ladder component.

8. The adjustable cabinet as defined in claim 7, wherein the release mechanism includes a body that has a shape of a letter "U" having the at least one bar at one or more corners and one or more ends of the U-shaped body.

9. The adjustable cabinet as defined in claim 8, wherein the bottom section includes a cut-out portion that has a general shape of the body of the release mechanism, wherein the cut-out portion houses the release mechanism.

10. The adjustable cabinet as defined in claim 8, wherein the at least one bar includes four bars extending horizontally at corners of the U-shaped body of the release mechanism, wherein the four bars extends along the plane of the top wall of the bottom section, wherein the bottom section includes four ladder components that engages the four bars to facilitate adjusting the top section in a downward and upward direction in relation to the bottom section.

11. The adjustable cabinet as defined in claim 8, wherein the release mechanism includes a handle that is attached to a base portion of the U-shaped body, wherein the handle is placed through a hole in the top wall of the bottom section such that the handle is positioned at a top surface of the top wall of the bottom section.

12. The adjustable cabinet as defined in claim 7, wherein the at least one side wall of the top section includes at least one cut-out portion on an inner surface of the at least one side wall of the top section, wherein the at least one cut-out portion houses the ladder component.

13. The adjustable cabinet as defined in claim 7, wherein the top section includes at least one extendable surface that extends horizontally in and out of the top section along the plane of the top wall of the top section.

14. The adjustable cabinet as defined in claim 7, wherein the top section includes at least one drawer.

* * * * *